US005341660A

United States Patent [19]

Berveglieri

[11] Patent Number: 5,341,660

[45] Date of Patent: Aug. 30, 1994

[54] DISPENSER-DISBRIBUTOR FOR LIQUID DETERGENT FOR WASHING MACHINES

[75] Inventor: Fabrizio Berveglieri, Genoa, Italy

[73] Assignee: Mira Lanza S.p.A., Milan, Italy

[21] Appl. No.: 37,443

[22] Filed: Mar. 26, 1993

[30] Foreign Application Priority Data

Jun. 26, 1992 [IT] Italy ..... GE92U000036

[51] Int. Cl.[5] ..... D06F 39/08

[52] U.S. Cl. ..... 68/17 R; 68/207; 118/258

[58] Field of Search ..... 68/17 R, 207; 401/143, 401/148, 149, 200, 209; 118/258, 259

[56] References Cited

U.S. PATENT DOCUMENTS

| | | | |
|---|---|---|---|
| 635,592 | 10/1899 | Rauhoff | 118/258 |
| 4,129,391 | 12/1978 | Gamacher | 402/208 |
| 4,993,860 | 2/1991 | Sommer | 401/209 X |

FOREIGN PATENT DOCUMENTS

| | | | |
|---|---|---|---|
| 346113 | 12/1989 | European Pat. Off. | 68/17 R |
| 63-222796 | 9/1988 | Japan | 68/17 R |
| 63-222797 | 9/1988 | Japan | 68/17 R |
| PCT/E89/00-020 | 8/1989 | PCT Int'l Appl. | 68/17 R |
| 2157717 | 10/1985 | United Kingdom | 68/17 R |

OTHER PUBLICATIONS

PCT/US91/08823 Jun. 11, 1992.
PCT/US91/08824 Jun. 11, 1992.

*Primary Examiner*—Frankie L. Stinson
*Attorney, Agent, or Firm*—Larson and Taylor

[57] ABSTRACT

Dispenser-distributor provided with a device for the local application of the liquid detergent. The device consists of an aperture let into the top part of the side surface of the dispenser-distributor whose orifice is intercepted by a circular-sectioned element rotatably supported about pins engaged in two recesses positioned on the rim of the aperture.

4 Claims, 2 Drawing Sheets

DISPENSER-DISBRIBUTOR FOR LIQUID DETERGENT FOR WASHING MACHINES

The present invention relates to dispensers-distributors for liquid detergent to be inserted together with the washing load in the drool a washing machine.

The use of such devices when washing by means of washing machines has been known for some time.

It is also known that the user will often apply a certain amount of detergent directly to the dirtiest marks on clothes or laundry in general, in order that they will be washed more thoroughly and efficiently.

The object of the present invention is to provide a dispenser-distributor that will facilitate this operation by guaranteeing efficient local application of the liquid detergent without waste.

This may be achieved by means of a dispenser-distributer provided with means of applying the liquid detergent directly to the fabric to be washed, these means consisting of an aperture in the surface of said dispenser-distributor whose orifice is intercepted by a circular-sectioned element, either a cylinder or a sphere; this element, pivoting on the rim of said aperture, will by rotating about its own axis enable the detergent to be applied to the desired point, spreading it; and will also make it possible to control the amount of said liquid detergent that comes out.

Further advantages and features will be made clearer by the following description of two embodiments of the present model, reference being made to the attached drawings in which.

Figure 2:
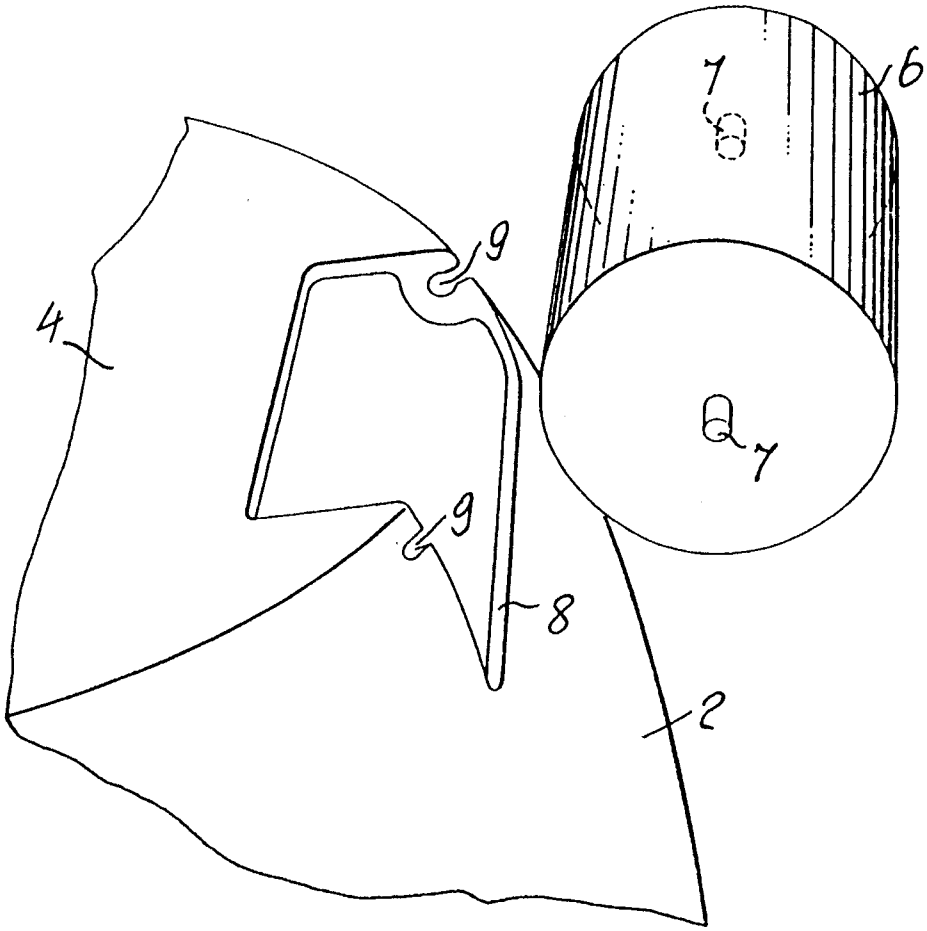
FIG. 2 is an enlarged perspective view of a detail of the applicator means of the embodiment shown in FIG. 1.
Figure 1:
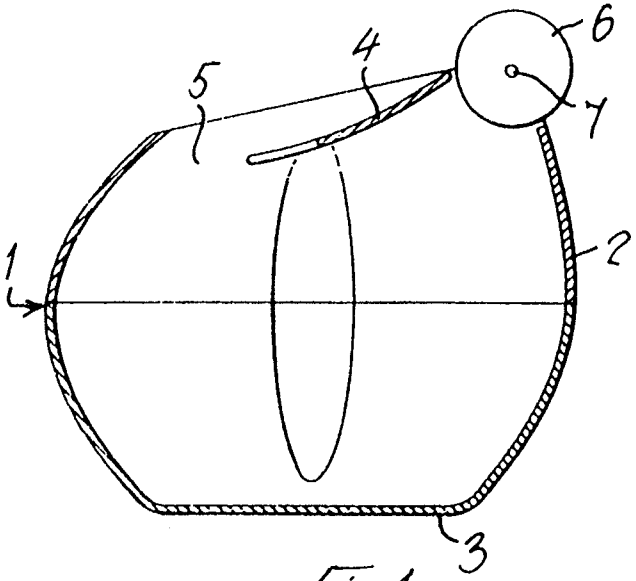
FIG. 1 is a view in longitudinal section of a first embodiment of the present model.
Figure 4:
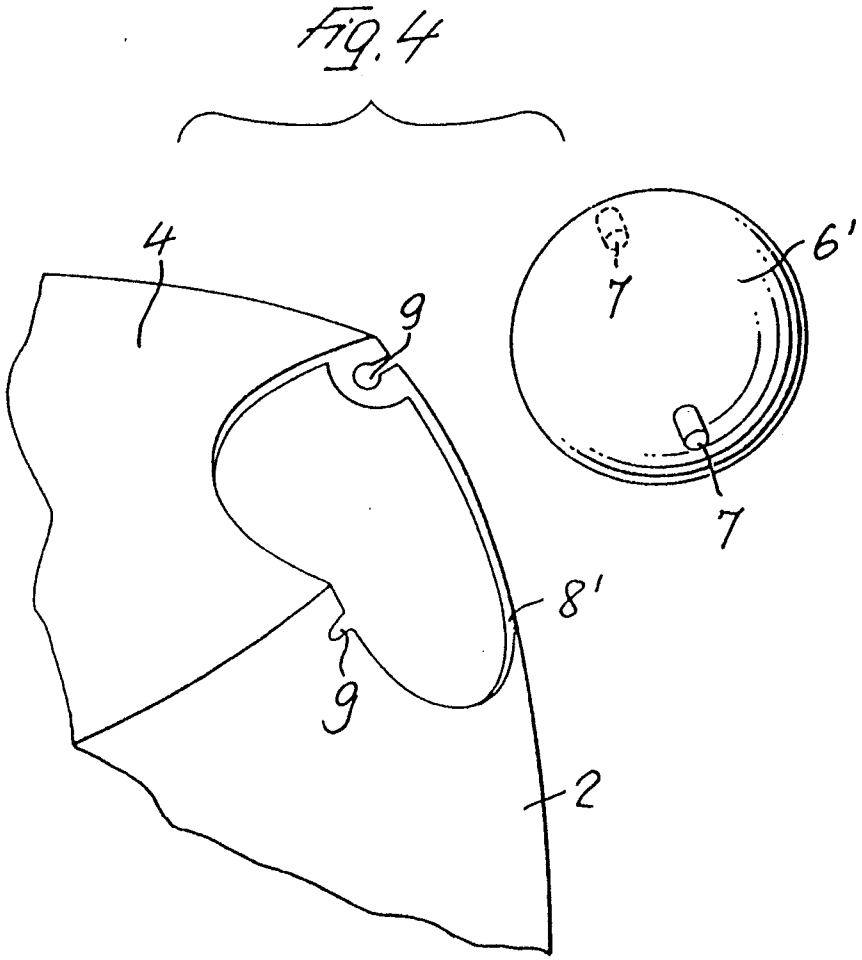
FIG. 4 is an enlarged perspective view of a detail of the applicator means of the embodiment shown in FIG. 2.
Figure 3:
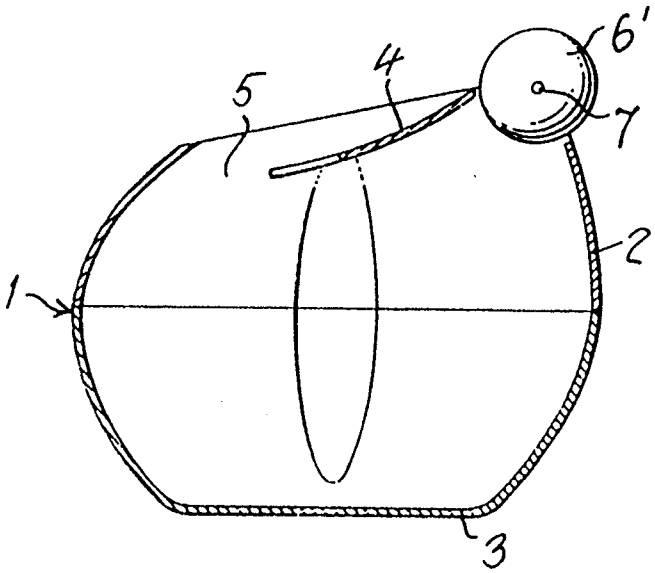
FIG. 3 is a view in longitudinal section of a second embodiment of the present model.

With reference to the drawings, and with particular reference to FIG. 1, 1 indicates a dispenser-distributor according to the present model. It consists of an essentially spheroidal container provided with a flat bottom 3 and a broad aperture in the diametrically opposite part. This aperture is partially intercepted by a curved top wall 4. This wall 4, in combination with the side wall 2, defines the aperture 5 through which the detergent is introduced. Let into a point at the intersection of the surfaces 2 and 4 is an aperture 8 (FIG. 2) in which there is inserted into the supporting recesses 9 a detergent applicator means 6, of circular section, which rotates on pins 7 that fit into the supporting recesses 9. Said applicator means may be a cylinder 6 or a sphere 6' as shown in FIG. 4.

The application of the liquid detergent to particular parts of the washing load is performed as follows. The detergent is introduced into the dispenser-distributor 1 through the aperture 5. At this point, if the user wishes locally to apply a certain amount of liquid detergent to points that are particularly difficult to wash, he simply takes the dispenser-distributor 1 in his hand and tips it so that the detergent moves up the walls 2 and 4 of the means towards the aperture 8. Then, as the applicator means (6, 6') is pressed onto the surface to which the detergent is to be applied, and moving the dispenser 1 back and forth over it, the detergent will be spread over said surface owing to the action of the applicator means (6, 6'). Afterwards the dispenser-distributor 1 can be introduced into the washing machine with the washing load, as is usual.

In this way it is possible to apply, by means of the same dispenser-distributor, which afterwards will be inserted with the washing load into the washing machine drum, the desired amount of liquid detergent to points believed to be particularly difficult to wash. Moreover said detergent is spread efficiently and with no further waste because the directly applied detergent is taken from the dose inserted previously into the dispenser-distributor 1.

I claim:

1. A dispenser-distributor for liquid detergent for insertion into a drum of a washing machine together with laundry to be washed comprising:

a hollow base member having a side surface and a top which meet at a corner;

a main opening in said top of said base member through which the liquid detergent is poured into said base member and from which the liquid detergent freely exits said base member; and an applicator means for applying the liquid detergent in said base member selectively to a desired portion of a component of the laundry, said applicator means including an aperture provided in said corner and defined by a surrounding rim, an element of circular cross section located in said aperture in said corner which substantially fills said aperture and which extends from outwardly from said aperture for application to a component adjacent said side or said top, said element including pins at opposite sides thereof, and opposed recesses in said rim in which said pins are received for mounting said element for rotation about said pins such that the liquid detergent in said hollow base member is spread onto the desired portion of the component of the laundry by rolling said element along a surface of the component.

2. A dispenser-distributor as claimed in claim 1 wherein said element is a cylinder.

3. A dispenser-distributor as claimed in claim 1 wherein said element is a sphere.

4. A dispenser-distributor as claimed in claim 1 wherein said corner is about 90° inside and said element is exposed for spreading the detergent over the remaining about 270° of said corner.

* * * * *